US008967951B2

(12) United States Patent
Klingler

(10) Patent No.: US 8,967,951 B2
(45) Date of Patent: Mar. 3, 2015

(54) TURBINE ASSEMBLY AND METHOD FOR SUPPORTING TURBINE COMPONENTS

(75) Inventor: Brett Darrick Klingler, Greenville, SC (US)

(73) Assignee: General Electric Company, Schenectady, NY (US)

( * ) Notice: Subject to any disclaimer, the term of this patent is extended or adjusted under 35 U.S.C. 154(b) by 600 days.

(21) Appl. No.: 13/347,298

(22) Filed: Jan. 10, 2012

(65) Prior Publication Data

US 2013/0177413 A1 Jul. 11, 2013

(51) Int. Cl.
*F01D 25/28* (2006.01)

(52) U.S. Cl.
USPC ..... 415/126; 415/209.2; 415/213.1; 415/214.1

(58) Field of Classification Search
USPC ..... 415/170.1, 173.1, 173.7, 213.1, 214.1, 415/209.2, 220; 416/244 R, 244 A
See application file for complete search history.

(56) References Cited

U.S. PATENT DOCUMENTS

| | | | | |
|---|---|---|---|---|
| 3,520,635 | A | 7/1970 | Killman et al. | |
| 3,937,589 | A * | 2/1976 | Remberg | 415/101 |
| 3,966,354 | A | 6/1976 | Patterson | |
| 3,975,901 | A | 8/1976 | Hallinger et al. | |
| 4,005,946 | A | 2/1977 | Brown et al. | |
| 4,050,843 | A | 9/1977 | Needham et al. | |
| 4,112,582 | A * | 9/1978 | Beckershoff | 33/655 |
| 4,213,296 | A | 7/1980 | Schwarz | |
| 4,230,436 | A | 10/1980 | Davison | |
| 4,242,042 | A | 12/1980 | Schwarz | |
| 4,279,123 | A | 7/1981 | Griffin et al. | |
| 4,304,093 | A | 12/1981 | Schulze | |
| 4,317,646 | A | 3/1982 | Steel et al. | |
| 4,326,804 | A | 4/1982 | Mossey | |
| 4,329,114 | A | 5/1982 | Johnston et al. | |
| 4,332,523 | A | 6/1982 | Smith | |
| 4,338,061 | A | 7/1982 | Beitler et al. | |
| 4,363,599 | A | 12/1982 | Cline et al. | |
| 4,513,567 | A | 4/1985 | Deveau et al. | |
| 4,683,716 | A | 8/1987 | Wright et al. | |
| 4,714,404 | A | 12/1987 | Lardellier | |
| 4,773,817 | A | 9/1988 | Stangalini et al. | |
| 4,842,477 | A | 6/1989 | Stowell | |
| 5,035,573 | A | 7/1991 | Tseng et al. | |
| 5,056,988 | A | 10/1991 | Corsmeier et al. | |

(Continued)

FOREIGN PATENT DOCUMENTS

| | | |
|---|---|---|
| EP | 0541325 A1 | 5/1993 |
| EP | 1942294 A1 | 7/2008 |

(Continued)

OTHER PUBLICATIONS

Search Report from EP Application No. 13150243.7 dated Dec. 4, 2013.

*Primary Examiner* — Dwayne J White
*Assistant Examiner* — Justin Seabe
(74) *Attorney, Agent, or Firm* — Cantor Colburn LLP

(57) ABSTRACT

According to one aspect of the invention, a turbine assembly includes a first static structure and a second static structure radially outward of the first static structure. The assembly also includes a support member placed in a recess of the second static structure, wherein the support member includes first and second curved surfaces to contact the first and second static structures, respectively, and wherein the support member includes a biasing structure to retain the support member in the recess.

16 Claims, 3 Drawing Sheets

(56) References Cited

U.S. PATENT DOCUMENTS

| | | | | |
|---|---|---|---|---|
| 5,096,375 | A | 3/1992 | Ciokailo | |
| 5,104,287 | A | 4/1992 | Ciokajlo | |
| 5,468,123 | A | 11/1995 | Guimier et al. | |
| 5,601,402 | A | 2/1997 | Wakeman et al. | |
| 5,603,510 | A | 2/1997 | Sanders | |
| 6,152,685 | A | 11/2000 | Hagi | |
| 7,309,209 | B2 | 12/2007 | Amiot et al. | |
| 7,575,409 | B2 | 8/2009 | Dierksmeier et al. | |
| 8,628,092 | B2 * | 1/2014 | Deo et al. | 277/412 |
| 2002/0071762 | A1 | 6/2002 | Schroder | |
| 2005/0232752 | A1 | 10/2005 | Meisels | |
| 2007/0110564 | A1 | 5/2007 | Leach et al. | |
| 2008/0069683 | A1 | 3/2008 | Nigmatulin et al. | |
| 2009/0232651 | A1 * | 9/2009 | Ballard et al. | 415/220 |
| 2010/0239415 | A1 * | 9/2010 | Turnquist et al. | 415/174.2 |

FOREIGN PATENT DOCUMENTS

| | | | |
|---|---|---|---|
| GB | 2099515 | A | 12/1982 |
| GB | 2468768 | A | 9/2010 |
| WO | 2005031197 | A1 | 4/2005 |

* cited by examiner

TURBINE ASSEMBLY AND METHOD FOR SUPPORTING TURBINE COMPONENTS

BACKGROUND OF THE INVENTION

The subject matter disclosed herein relates to turbines. More particularly, the subject matter relates to an assembly of turbine static structures.

In turbine engines, such as steam or gas turbine engines, static or non-rotating structures may have certain clearances when placed adjacent to one another. The clearances between adjacent structures allow for movement caused by temperature changes or pressure changes. For instance, in a gas turbine engine, a combustor converts chemical energy of a fuel or an air-fuel mixture into thermal energy. The thermal energy is conveyed by a fluid, often air from a compressor, to a turbine where the thermal energy is converted to mechanical energy. High combustion temperatures and/or pressures in selected locations, such as the combustor and turbine nozzle areas, may enable improved combustion efficiency and power production. In some cases, high temperatures and/or pressures in certain turbine structures may cause relative movement of adjacent structures, which can cause contact and friction that lead to stress and wear of the structures. For example, stator structures, such as rings or casing, are circumferentially joined about the turbine case and are exposed to high temperatures and pressure as the hot gas flows along the stator.

It is desirable to improve turbine performance by reducing turbine clearances. In some cases reducing clearances requires accounting for eccentricity, out of roundness and part variation.

BRIEF DESCRIPTION OF THE INVENTION

According to one aspect of the invention, a turbine assembly includes a first static structure and a second static structure radially outward of the first static structure. The assembly also includes a support member placed in a recess of the second static structure, wherein the support member includes first and second curved surfaces to contact the first and second static structures, respectively, and wherein the support member includes a biasing structure to retain the support member in the recess.

According to another aspect of the invention, a method for supporting turbine components includes positioning an inner turbine shell substantially concentric with a rotor and surrounding the inner turbine shell with an outer turbine shell. The method also includes supporting the inner turbine shell with respect to the outer turbine shell with a support member, wherein the support member includes a biasing structure configured to maintain a position of the support member when the support member is not in contact with one of the inner or outer turbine shell.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Embodiments of the present invention include a clearance control system that adjusts the position of an inner turbine shell with respect to a rotor and/or an outer turbine shell. In doing so, the system addresses several parameters to reduce operating clearance between rotating and stationary components in the turbine to improve performance in a cost-effective manner. The key parameters include friction, eccentricity, out of roundness, muscle, cost, and ease-of-use. They system may further include clearance control structures and methods to control the temperature, and thus the expansion and contraction, of the inner turbine shell. Although various embodiments of the present invention may be described and illustrated in the context of a turbine, one of ordinary skill in the art will understand that the principles and teachings of the present application apply equally to type of turbine having rotating and stationary components in close proximity.

Figure 1:
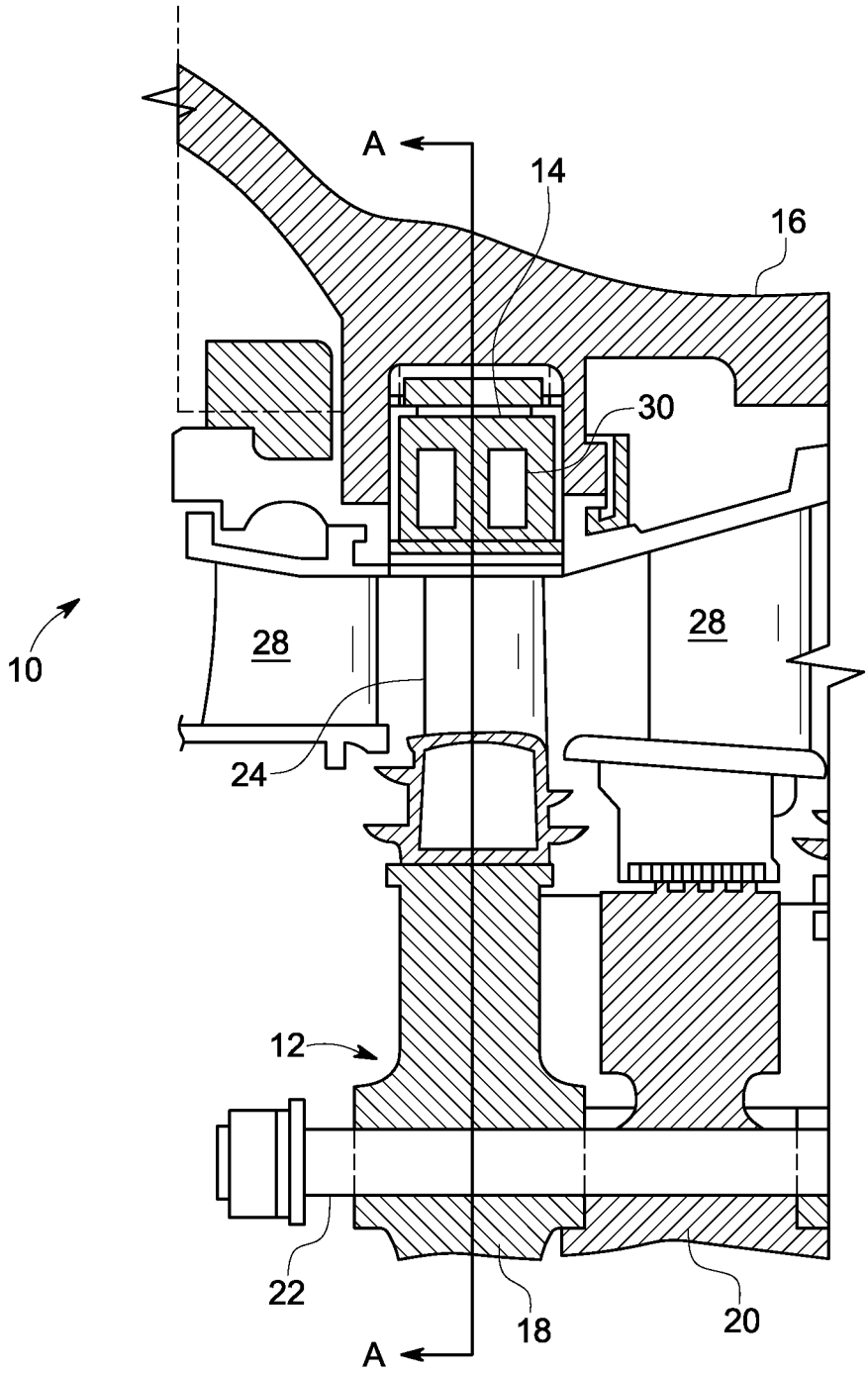
FIG. 1 is partial cross-section of an exemplary turbine.

FIG. 1 provides a simplified partial cross-section of a turbine 10 according to one embodiment of the present invention. As shown, the turbine 10 generally includes a rotor 12, one or more inner turbine shells 14, and an outer turbine shell 16. The rotor 12 includes a plurality of turbine wheels 18 separated by spacers 20 along the length of the rotor 12. A bolt 22 extends through the turbine wheels 18 and spacers 20 to hold them in place and collectively form a portion of the rotor 12. Circumferentially spaced turbine buckets 24 connect to and extend radially outward from each turbine wheel 18 to form a stage in the turbine 10. For example, the turbine 10 shown in FIG. 1 includes three stages of turbine buckets 24, although the present invention is not limited to the number of stages included in the turbine 10.

The inner turbine shells 14 completely surround at least a portion of the rotor 12. As shown in FIG. 1, for example, a separate inner turbine shell 14 completely surrounds the outer perimeter of each stage of turbine buckets 24. In this manner, the inner turbine shells 14 and the outer periphery of the turbine buckets 24 reduce the flow of hot gases that bypass a turbine stage. The outer turbine shell 16 generally surrounds the rotor 12 and the inner turbine shell 14. Circumferentially spaced nozzles 28 connect to the outer turbine shell 16 and extend radially inward toward the spacers 20. For example, as shown in FIG. 1, the first stage nozzle 28 at the far left connects to the outer turbine shell 16 so that the flow of the gases over the first stage nozzle 28 exerts a pressure against the outer turbine shell 16 in the downstream direction.

As shown in FIG. 1, the inner turbine shell 14 may include on or more internal passages 30. These passages 30 allow for the flow of a medium to heat or cool the inner turbine shell 14, as desired. For example, airflow from a compressor or combustor may be diverted form the hot gas path and metered through the passages 30 in the inner turbine shell 14. In this manner, the inner turbine shell 14 may be heated or cooled to allow it to expand or contract radially in a controlled manner to achieve a designed clearance between the inner turbine shell 14 and the outer periphery of the turbine buckets 24. For example, during turbine 10 startup, heated air may be circulated through the various passages 30 of the inner turbine shell 14 to radially expand the inner turbine shell 14 outwardly form the outer periphery of the turbine buckets 24.

Since the inner turbine shell 14 heats up faster than the rotor 12, this ensure adequate clearance between the inner turbine shell 14 and the outer periphery of the turbine buckets 24 during startup. During steady-state operations, the temperature of the air supplied to the inner turbine shell 14 may be adjusted to contract and expand the inner turbine shell 14 relative to the outer periphery of the turbine buckets 24, thereby producing the desired clearance between the inner turbine shell 14 and the outer periphery of the turbine buckets 24 to enhance the efficiency of the turbine 10 operation. Similarly, during turbine 10 shutdown, the temperature of the air supplied to the inner turbine shell 14 may be adjusted to endure the inner turbine shell 14 contracts slower than the turbine buckets 24 to avoid excessive contact between the outer periphery of the turbine buckets 24 and the inner turbine shell 14. To that end, the temperature of the medium may be adjusted to maintain a desired clearance during the shutdown.

As used herein, "downstream" and "upstream" are terms that indicate a direction relative to the flow of working fluid through the turbine. As such, the term "downstream" refers to a direction that generally corresponds to the direction of the flow of working fluid, and the term "upstream" generally refers to the direction that is opposite of the direction of flow of working fluid. The term "radial" refers to movement or position perpendicular to an axis or center line. It may be useful to describe parts that are at differing radial positions with regard to an axis. In this case, if a first component resides closer to the axis than a second component, it may be stated herein that the first component is "radially inward" of the second component. If, on the other hand, the first component resides further from the axis than the second component, it may be stated herein that the first component is "radially outward" or "outboard" of the second component. The term "axial" refers to movement or position parallel to an axis. Finally, the term "circumferential" refers to movement or position around an axis. Although the following discussion primarily focuses on turbines, the concepts discussed are not limited to turbines and may apply to any rotating machinery.

Figure 2:
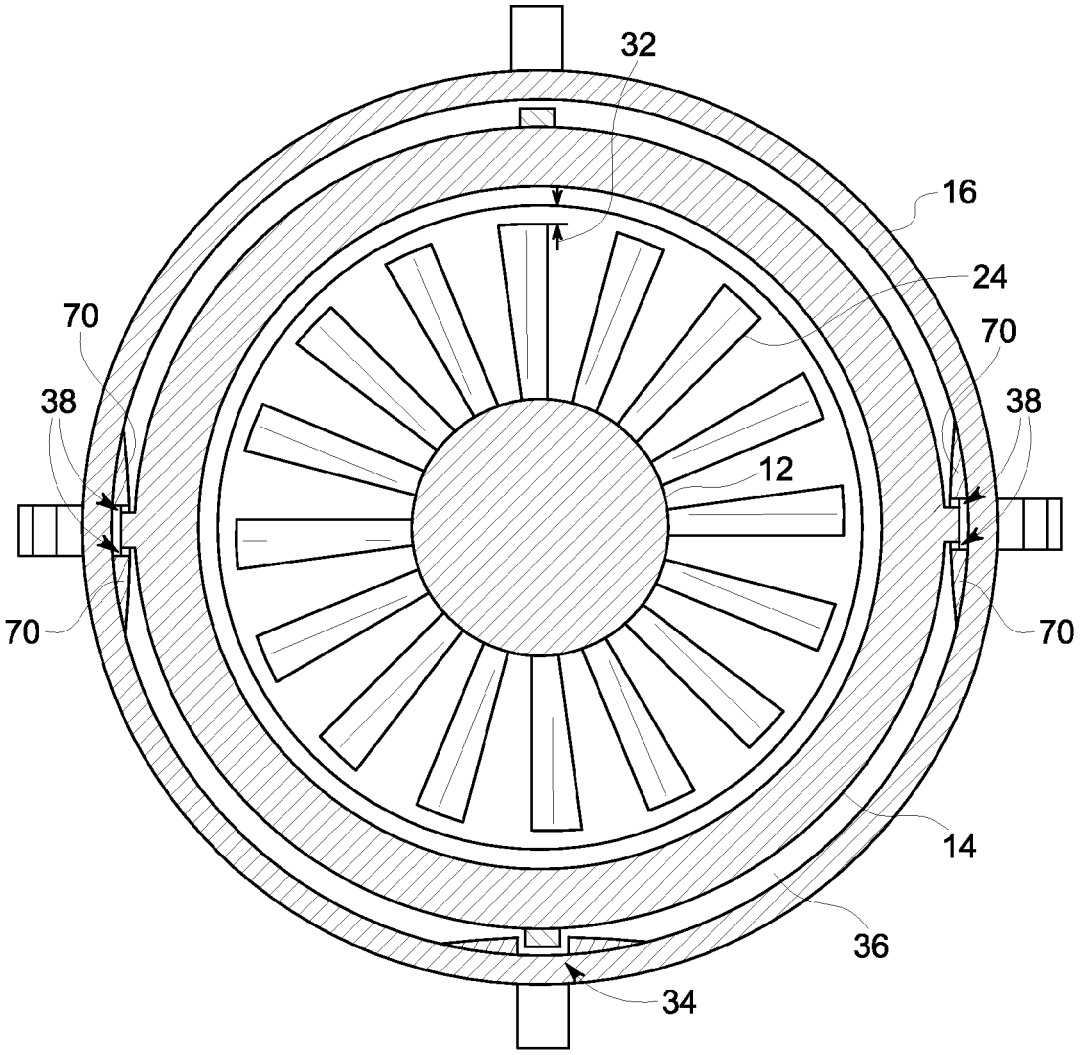
FIG. 2 is a simplified axial cross-section of the turbine shown in FIG. 1.

FIG. 2 shows a simplified axial cross-section of the turbine 10 shown in FIG. 1 taken along line A-A. In this view, the rotor 12 is in the center with the turbine buckets 24 extending radially therefrom. The inner turbine shell 14 completely surrounds the turbine buckets 24 and at least a portion of the rotor 12, providing a clearance 32 between the inner turbine shell 14 and the outer periphery of the turbine buckets 24. In an embodiment, the inner turbine shell 14 comprises a single-piece construction that completely surrounds a portion of the rotor 12. The single-piece design reduces eccentricities and out of roundness that may occur in multi-piece designs. Other embodiments may include an inner turbine shell 14 comprising multiple pieces that completely surround a portion of the rotor 12. A block, key or other detent 34 between the bottom of the inner turbine shell 14 and the bottom of the outer turbine shell 16 may be used to fix the inner turbine shell 14 laterally in place and restrict the inner turbine shell 14 from rotational movement with respect to the rotor 12 and/or the outer turbine shell 16.

As shown in FIG. 2, a gap 36 or space exists between the inner turbine shell 14 and outer turbine shell 16. As a result, the inner turbine shell 14 is physically isolated form the outer turbine shell 16, preventing any distortion, contraction, or expansion of the outer turbine shell 16 from being transmitted to the inner turbine shell 14. For example, eccentricities or out of roundness created by thermal gradients of the hot gas path in the outer turbine shell 16 will not be transmitted to the inner turbine shell 14 and will therefore not affect the design clearance 32 between the inner turbine shell 14 and outer periphery of the turbine buckets 24.

A support member assembly 38 provides support between the inner turbine shell 14 and the outer turbine shell 16. In the case of an inner turbine shell 14 comprising a single-piece construction, the assembly 38 may be located between the inner turbine shell 14 and the outer turbine shell 16 on opposite sides at approximately the vertical midpoint (i.e., approximately half of the distance between the top and bottom of the inner turbine shell 14) of the inner turbine shell 14. In other embodiments having multi-piece inner turbine shell 14, the system may include multiple support member assemblies 38 evenly spaced around the periphery of the inner turbine shell 14. In an embodiment, the outer turbine shell 14 includes shelf members 70 configured to contact the support member assembly 38.

Figure 3:
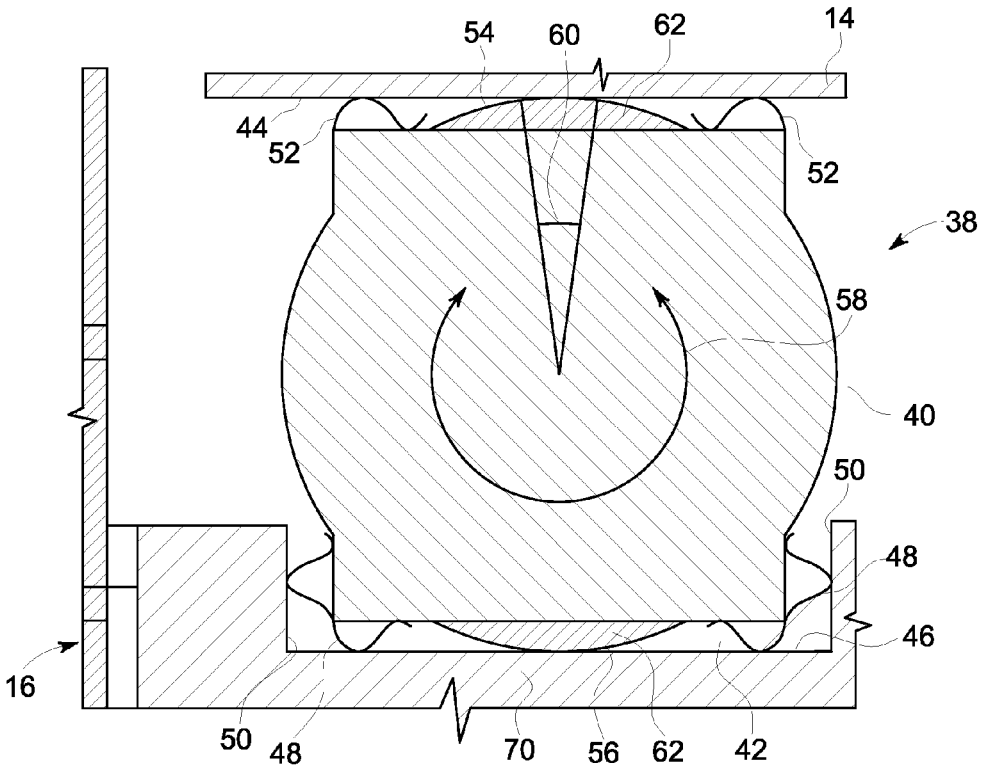
FIG. 3 is a detailed sectional view of a turbine assembly.

The depicted embodiment of the support member assembly 38 reduces the friction between two independent static turbine structures, such as the inner turbine shell 14 and outer turbine shell 16. As shown in FIG. 3, the support member assembly 38 includes a support member 40, such as a rolling block, that reduces friction during relative movement of the structures. In addition, the exemplary assembly and support member 40 has fewer parts than other embodiments of the turbine assembly. The support member is also configured to retain the member's orientation and position when not in contact with at least one of the shell structures 14, 16. As depicted, the support member 40 is in contact with support surfaces 44 and 46 of the inner turbine shell 14 and outer turbine shell 16, respectively. Further, a recess 42 in the outer shell structure 16 receives the support member 40.

The exemplary support member 40 comprises a substantially square block with round edges. The support member 40 is a stiff structure that is able to roll or rotationally move 58 as the inner and outer shell structures 14 and 16 move relative to each other. The support member 40 includes biasing members 48 and 52 to support the block. In an embodiment, the biasing members 48 and 52 are springs positioned proximate corners of the support member 40. Specifically, the biasing members 48 are positioned in the recess 42 and contact support surface 46 and lateral surfaces 50 to retain the support member 40 when the member is not in contact with the support surface 44. In an example, by retaining the support member 40 within the recess 42, the position and orientation of the support member 40 is maintained. Further, the biasing members 48 are configured to have a selected stiffness to allow the rotational movement 58 of the support member 40 during relative movement of the shell structures 14, 16. The biasing members 52 provide support and enable the support member 40 to maintain the desired orientation when forces, such as gravity, cause the curved surface 54 to contact the support surface 44.

Relative movement of the shell structures 14, 16 causes the support member 40 to roll and rotate a small angle 60. For example, a relative movement between the inner shell structure 14 and outer shell structure 16 of about 0.200 inches may result in a rotation of about 4 degrees for the small angle 60. In addition, curved surfaces 54 and 56 contact support surfaces 44 and 46, respectively, to allow rotational movement 58 with reduced friction. The exemplary curved surfaces 54, 56 comprise a high strength material, such as high strength stainless steel or high nickel alloy. In embodiments, the entire support member 40 may comprise the high strength material or may have the block portion comprise a different material, such as carbon steel or other suitable stainless steel. Reduced friction provided by the support member assembly 38 enables reduced clearances between adjacent turbine parts, such as shell structures 14, 16, to improve performance and efficiency. Further, the reduced friction provided by the support member 40 reduces eccentricity and out of roundness for components while reducing costs.

In an embodiment, two or more support members are placed at each support member assembly 38 location (as shown in FIG. 2), wherein the second and "opposite" support member is substantially a mirror image of the member in FIG. 3 taken across a vertical midpoint of the inner shell structure 14. The opposite support member is adjacent to the support member 40 and across a line running through the vertical midpoint. Accordingly, the opposite support member is positioned to contact a surface of inner shell structure 14 that is substantially parallel to support surface 44.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbine assembly comprising:

a first static structure;

a second static structure radially outward of the first static structure; and a support member placed in a recess of the second static structure, wherein the support member comprises first and second curved surfaces to contact the first and second static structures, respectively, wherein the support member comprises a biasing structure to retain the support member in the recess, wherein the first and second curved surfaces enable rotation of the support member to enable relative movement of the first and second static structures with reduced friction.

2. The turbine assembly of claim 1, wherein the recess comprises a support surface configured to contact the second curved surface of the support member.

3. The turbine assembly of claim 2, wherein the recess comprises two lateral surfaces adjoining the support surface.

4. The turbine assembly of claim 3, wherein the biasing structure contacts the two lateral surfaces to retain the support member when the support member is not in contact with the first static structure.

5. The turbine assembly of claim 3, wherein the biasing structure contacts the support surface on each side of the second curved surface.

6. The turbine assembly of claim 1, comprising a second biasing structure configured to contact the first static structure on each side of the first curved surface.

7. The turbine assembly of claim 1, wherein the first and second curved surfaces comprise a high strength stainless steel or high nickel alloy and at least a portion of the support member comprises a carbon steel.

8. The turbine assembly of claim 1, wherein the biasing structure maintains a position of the support member when the support member is not in contact with one of the first or second static structures.

9. A turbine assembly comprising:

a first static structure;

a second static structure radially outward of the first static structure; and a support member placed in a recess of the second static structure, wherein the support member comprises first and second curved surfaces to contact the first and second static structures, respectively, wherein the support member comprises a biasing structure to retain the support member in the recess, wherein the first and second curved surfaces enable rotation of the support member while the biasing structure is deformed.

10. A turbine comprising:

a rotor;

an inner turbine shell disposed about at least a portion of the rotor, wherein the inner turbine shell comprises a first support surface;

an outer turbine shell disposed about the inner turbine shell, wherein the outer turbine shell comprises a second support surface substantially adjacent to the first support surface; and a first support member disposed between the first and second support surfaces to enable relative movement of the inner and outer turbine shells, the first support member comprising first and second curved surfaces to contact the first and second support surfaces, respectively, wherein the first support member comprises a biasing structure configured to maintain a position of the first support member when the first support member is not in contact with one of the first or second support surfaces, and wherein the first and second curved surfaces enable rotation of the first support member to enable relative movement of the inner turbine shell and the outer turbine shell with reduced friction.

11. The turbine of claim 10, wherein the inner turbine shell comprises a third support surface and the outer turbine shell comprises a fourth support surface and a second support member is disposed substantially adjacent to the first support member between the third and fourth support surfaces to enable relative movement of the inner and outer turbine shells, wherein the second support member comprises a second biasing structure configured to maintain a position of the second support member when the second support member is not in contact with one of the third or fourth support surfaces.

12. The turbine of claim 10, wherein the first support member comprises first and second curved surfaces to contact the first and second support surfaces, respectively.

13. The turbine of claim 10, wherein the biasing structure retains the first support member against the second support surface when the first support member is not in contact with the first support surface.

14. The turbine of claim 10, wherein the first support member is located substantially at a vertical midpoint of the inner turbine shell.

15. The turbine of claim 10, wherein the inner turbine shell comprises a single piece.

16. The turbine of claim 10, wherein the inner turbine shell defines an internal passage through with a fluid flows to heat or cool the inner turbine shell.

* * * * *